US009949329B2

(12) United States Patent
Doi

(10) Patent No.: US 9,949,329 B2
(45) Date of Patent: Apr. 17, 2018

(54) LIGHTING DEVICE AND LUMINAIRE CAPABLE OF DETERMINING A TURNED-OFF STATE OF A LOAD CONNECTED THERETO WHEN POWER SUPPLY IS OFF

(71) Applicant: Panasonic Intellectual Property Management Co., Ltd., Osaka (JP)

(72) Inventor: Katsuyuki Doi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/646,525

(22) Filed: Jul. 11, 2017

(65) Prior Publication Data

US 2018/0027622 A1 Jan. 25, 2018

(30) Foreign Application Priority Data

Jul. 19, 2016 (JP) ..... 2016-141595

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 33/0848* (2013.01); *H05B 33/0851* (2013.01); *H05B 37/0272* (2013.01)

(58) Field of Classification Search
CPC ..... H05B 37/0272; H05B 33/0848; H05B 33/0851
USPC ..... 315/185 R, 209 R, 291, 308
See application file for complete search history.

(56) References Cited

U.S. PATENT DOCUMENTS

2011/0148319 A1* 6/2011 Terazawa ..... H02M 3/33507 315/291
2015/0208479 A1* 7/2015 Radermacher ..... H05B 33/0815 315/297
2016/0374164 A1* 12/2016 Stevens, Jr. ..... H05B 33/0815

FOREIGN PATENT DOCUMENTS

JP 2014-130768 A 7/2014

* cited by examiner

*Primary Examiner* — Thuy Vinh Tran
(74) *Attorney, Agent, or Firm* — Renner Otto Boisselle & Sklar, LLP

(57) ABSTRACT

In a lighting device, a voltage detector outputs a detection voltage with a magnitude corresponding to a magnitude of a DC voltage outputted from a power supply circuit, a state determiner makes determination of whether a light source is in a turned-on state or in a turned-off state, a power controller is configured to control a DC power supplied from the power supply circuit based on a result of the determination by the state determiner, and the state determiner determines, when a value obtained by subtracting the detection voltage from a first reference voltage is equal to or larger than a first threshold value, that the light source is in the turned-off state.

19 Claims, 5 Drawing Sheets

LIGHTING DEVICE AND LUMINAIRE CAPABLE OF DETERMINING A TURNED-OFF STATE OF A LOAD CONNECTED THERETO WHEN POWER SUPPLY IS OFF

CROSS-REFERENCE TO RELATED APPLICATION

The present application is based upon and claims the benefit of priority of Japanese Patent Application No. 2016-141595, filed on Jul. 19, 2016, the entire contents of which are incorporated herein by reference.

TECHNICAL FIELD

The present disclosure relates to lighting devices and luminaires.

BACKGROUND ART

Conventionally, there has been known a lighting device configured to supply direct current (DC) power to a light source. The lighting device includes a DC power supply configured to convert an alternating current (AC) voltage into a DC voltage in response to an AC power. The light source includes a solid-state light emitting element(s) such as a light emitting diode(s) (LED).

For example, a lighting device disclosed in Document 1 (JP2014-130768A) can operate any of multiple kinds of light sources having different forward voltages. Specifically, the lighting device of Document 1 is configured to detect a forward voltage, which is defined as a voltage drop across the light source, and compare the detected forward voltage with two or more threshold values, thereby determining which kind of light source is connected to the lighting device.

Incidentally, when supply of power from an external power supply to a lighting device is stopped (when the power supply is off), the light source connected to the lighting device is turned off. However, the conventional lighting device, which can operate any of the multiple kinds of light sources having different forward voltages, has a difficulty in detecting whether a light source connected thereto is turned off (is in a turned-off state) or not.

When the lighting device cannot detect the turned-off state of the light source (cannot detect that the light source is turned off) at the time the power supply is off, a dimming control by the lighting device may be performed incorrectly after the lighting source is turned on again.

It is therefore desired a lighting device and a luminaire, which can operate any of multiple kinds of light sources having different forward voltages, and can certainly determine a turned-off state of the light source connected thereto as the load when a power supply is off.

SUMMARY

An object of the present disclosure is to provide a lighting device and a luminaire which can certainly determine a turned-off state of a light source employed as a load when a power supply is off, particularly in the case where light sources having different forward voltages may be employed as the load.

A lighting device according to an aspect of the present disclosure includes a power supply circuit, a control power supply, and a control circuit. The power supply circuit is configured to output a DC voltage in response to input of external power to supply a DC power to a light source that includes at least one solid-state light emitting element. The control power supply is configured to output a control voltage in response to input of the external power inputted into the power supply circuit or power derived from the external power inputted into the power supply circuit. The control circuit is configured to operate with the control voltage to control the power supply circuit. The control circuit includes a voltage detector, a state determiner, and a power controller. The voltage detector is configured to output a detection voltage with a magnitude corresponding to a magnitude of the DC voltage outputted from the power supply circuit. The state determiner is configured to make determination of whether the light source is in a turned-on state or in a turned-off state. The power controller is configured to control the DC power supplied from the power supply circuit based on a result of the determination by the state determiner. The state determiner is configured to, when a value obtained by subtracting the detection voltage from a reference voltage is equal to or larger than a threshold value, determine that the light source is in the turned-off state.

A luminaire according to an aspect of the present disclosure includes the lighting device; a light source including at least one solid-state light emitting element and supplied with the DC power from the lighting device; and a casing to which the light source is attached.

BRIEF DESCRIPTION OF THE DRAWINGS

The figures depict one or more implementations in accordance with the present teaching, by way of example only, not by way of limitations. In the figure, like reference numerals refer to the same or similar elements.

DETAILED DESCRIPTION

The present embodiment relates generally to lighting devices and luminaires. More particularly, the present embodiment relates to a lighting device and a luminaire which can operate any of multiple kinds of light sources having different forward voltages.

The embodiment of the present disclosure is described with reference to drawings.

Figure 1:
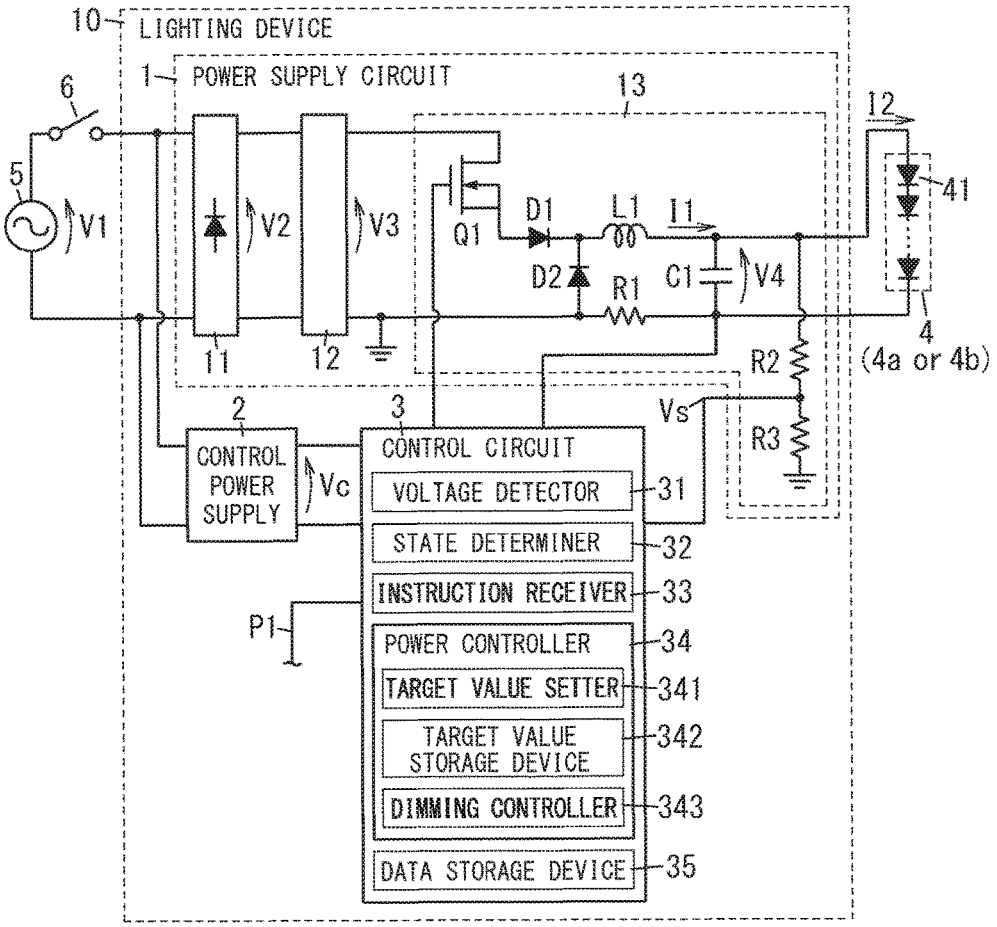
FIG. 1 is a circuit diagram of a lighting device according to an embodiment.

FIG. 1 is a circuit diagram of a lighting device 10 of the present embodiment.

The lighting device 10 includes a power supply circuit 1, a control power supply 2 and a control circuit 3, and is configured to light (turn on) a light source 4. The light source 4 includes a plurality of LEDs 41 (solid-state light emitting elements). In the present embodiment, the plurality of LEDs 41 is connected in series. In this case, the light source 4 has a forward voltage defined as a sum of forward voltages of the plurality of LEDs 41 connected in series.

The lighting device 10 is configured to receive an AC power (external power) from a commercial power supply 5 which serves as an external power supply. A switch 6 is interposed in a power supply line between the commercial power supply 5 and the lighting device 10. The AC power from the commercial power supply 5 to the lighting device 10 is allowed to be supplied or is cut off, in response to ON and OFF of the switch 6.

The power supply circuit 1 includes a rectifier circuit 11, a power factor correction circuit 12, and a step-down chopper circuit 13, and is configured to supply DC power to the light source 4.

The rectifier circuit 11 is configured to, in response to input of the power from the commercial power supply 5, generate a rectified voltage V2 obtained by rectification (such as full-wave rectification) on an AC voltage V1 from the commercial power supply 5, and output the rectified voltage V2.

The power factor correction circuit 12 may include a step-up chopper circuit configured to increase a voltage level of the rectified voltage V2. The power factor correction circuit 12 is configured to generate, across output terminals thereof, a desired stepped-up voltage V3. The power factor correction circuit 12 including the step-up chopper circuit is known and explanation thereof omitted here.

The step-down chopper circuit 13 is described in detail hereinafter.

A switching device Q1 which may be a field effect transistor (FET), a diode D1, an inductor L1, a capacitor C1, and a resistor R1 are connected in series to form a series circuit which is electrically connected between the output terminals of the power factor correction circuit 12. These elements of the series circuit are connected in an order of the switching device Q1, the diode D1, the inductor L1, the capacitor C1, and the resistor R1, from a high-potential side output terminal of the power factor correction circuit 12 to a low-potential side output terminal of the power factor correction circuit 12. A diode D2 for energy regeneration is electrically connected across a series circuit of the inductor L1, the capacitor C1, and the resistor R1.

A DC voltage V4 is generated across the capacitor C1. The light source 4 is electrically connected between both terminals of the capacitor C1.

The resistor R1 is configured to generate, across thereof, a voltage which is proportional to a current I1 (hereinafter referred to as "inductor current I1") flowing through the inductor L1. The control circuit 3 receives the voltage across the resistor R1, which indicates a detection value of the inductor current I1.

A series circuit of resistors R2 and R3 is connected between a high-potential side terminal of the capacitor C1 and a low-potential side terminal (i.e., ground) of the power factor correction circuit 12 which outputs the stepped-up voltage V3. The control circuit 3 is configured to receive a voltage at a connection point of the resistors R2 and R3 (i.e., receive a voltage across the resistor R3).

The control circuit 3 is powered by the control power supply 2. The control power supply 2 is configured to output a desired control voltage Vc in response to input of the AC voltage V1 from the commercial power supply 5. The control voltage Vc is DC voltage suitable for operating the control circuit 3, and may have a value of 5 [V], 12 [V], 24 [V], or the like. The control power supply 2 may include a switching regulator, or a linear power supply.

The control circuit 3 operates with the input control voltage Vc, and is configured to turn on and off the switching device Q1 at a high-frequency, thereby generating the DC voltage V4 across the capacitor C1 decreased from the stepped-up voltage V3. The light source 4 is electrically connected between both terminals of the capacitor C1, and is supplied with a load current I2 from the capacitor C1. A dimming level of the light source 4 increases with an increase in the load current I2, and the dimming level of the light source 4 decreases with a decrease in the load current I2. The dimming level of the light source 4 may be defined as a ratio of a light level based on a light level of a full-lighting state, for example.

Specifically, in the step-down chopper circuit 13, when the switching device Q1 is turned on, a current flows from the power factor correction circuit 12, through the switching device Q1, the diode D1, the inductor L1, the capacitor C1, and the resistor R1, to the power factor correction circuit 12, in this order. When the switching device Q1 is turned off, magnetic energy stored in the inductor L1 is discharged to cause a current flow from the inductor L1, through the capacitor C1, the resistor R1, and the diode D2, to the inductor L1, in this order. As a result of repeated turning on and off of the switching device Q1, the DC voltage V4 is generated across the capacitor C1 and the load current I2 flows from the capacitor C1 to the light source 4. The light source 4 emits light according to the load current I2.

The control circuit 3 is configured to adjust the output of the step-down chopper circuit 13, thereby dimming the light source 4. The control circuit 3 stores in advance a correspondence relation between the dimming level of the light source 4 and the inductor current I1. The control circuit 3 is configured to control an ON duty in a PWM control of the switching device Q1 so that the detection value of the inductor current I1 agrees to a value of the inductor current I1 associated with a target value of a dimming level (hereinafter, referred to as "dimming target value"), thereby adjusting the dimming level of the light source 4 to the dimming target value.

The control circuit 3 includes a voltage detector 31, a state determiner 32, an instruction receiver 33, a power controller 34, and a data storage device 35. For example, the control circuit 3 includes a computer such as a micro-computer. Preferably, at least functions of the state determiner 32 and the power controller 34 (other than a function of a target value storage device 342 described later) are realized by the computer executing a program.

The computer of the control circuit 3 includes, as main hardware components, a processor configured to operate according to programs, and an interface. Examples of the processor include a Digital Signal Processor (DSP), Central Processing Unit (CPU), and a Micro-Processing Unit (MPU). Types of the processor are not particularly limited as long as the processor can realize the functions of at least the state determiner 32 and the power controller 34 by executing the program.

The program may be provided through a storage medium such as a computer readable Read Only Memory (ROM) or an optical disc that stores the program in advance, may be provided through a wide area communication network such as the Internet, or the like.

The voltage detector 31 is configured to receive a detection voltage Vs which is the DC voltage V4 generated across the resistor R3. The detection voltage Vs may be a partial voltage of the DC voltage V4 divided by the resistors R2 and R3.

The state determiner 32 is configured to make determination of whether the light source 4 is in a turned-on state or in a turned-off state (whether the light source 4 is turned on or off), based on the detection voltage Vs. Operation of the state determiner 32 will be described later.

The data storage device 35 stores various data to be used by the control circuit 3. The data storage device 35 may be a non-volatile rewritable memory. The data storage device 35 may include an Electrically Erasable and Programmable Read-Only Memory (EEPROM), a Flash Memory, or the like.

The power controller 34 is configured to control the DC power supplied from the power supply circuit 1 (the step-down chopper circuit 13) based on a result of the determination by the state determiner 32. The power controller 34 includes a target value setter 341, a target value storage device 342, and a dimming controller 343.

The target value setter 341 is configured to set the dimming target value of the light source 4.

The target value storage device 342 is configured to store data on the dimming target value set by the target value setter 341. The target value storage device 342 may be a non-volatile rewritable memory. The target value storage device 342 may include an Electrically Erasable and Programmable Read-Only Memory (EEPROM), a Flash Memory, or the like.

The dimming controller 343 is configured to control the DC power supplied from the power supply circuit 1 (the step-down chopper circuit 13) so that the dimming level of the light source 4 agrees to the dimming target value stored in the target value storage device 342.

Hereinafter, a state determination process of the light source 4 performed by the state determiner 32 will be explained with reference to a wave form chart of FIG. 2 and a flowchart of FIG. 3.

Figure 2:
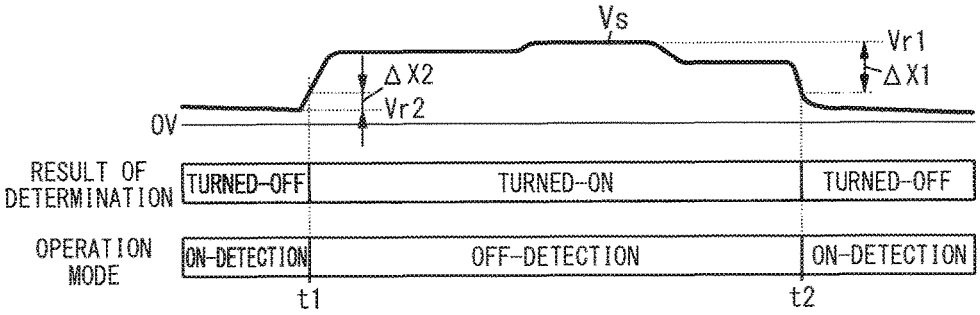
FIG. 2 is a wave form chart illustrating a state determination process by the lighting device.

The state determiner 32 is configured to set a first reference voltage Vr1 and a second reference voltage Vr2 shown in FIG. 2. The first reference voltage Vr1 corresponds to a maximum value of the detection voltage Vs within a period over which the state determiner 32 continues determining that the light source 4 is in the turned-on state. The second reference voltage Vr2 corresponds to a minimum value of the detection voltage Vs within a period over which the state determiner 32 continues determining that the light source 4 is in the turned-off state. Thus, the first reference voltage Vr1 and the second reference voltage Vr2 satisfy a relation of "first reference voltage Vr1>second reference voltage Vr2".

The state determiner 32 includes, as its operation modes, "OFF-detection mode" and "ON-detection mode". The operation mode of the state determiner 32 is set to either of the OFF-detection mode and the ON-detection mode.

While operating in the OFF-detection mode, the state determiner 32 determines that the light source 4 is in the turned-off state (timing t2), when a value (hereinafter, referred to as "first difference [Vr1−Vs]") obtained by subtracting the detection voltage Vs from the first reference voltage Vr1 is equal to or larger than a first threshold value ΔX1 (i.e., when the relation "Vr1−Vs≥ΔX1" is satisfied).

While operating in the ON-detection mode, the state determiner 32 determines (timing t1) that the light source 4 is in the turned-on state, when a value (hereinafter, referred to as "second difference [Vs−Vr2]") obtained by subtracting the second reference voltage Vr2 from the detection voltage Vs is equal to or larger than a second threshold value ΔX2 (i.e., when the relation "Vs−Vr2≥ΔX2" is satisfied).

Each of the first threshold value ΔX1 and the second threshold value ΔX2 is a constant value, and set in advance. Each data on the first reference voltage Vr1, the second reference voltage Vr2, the first threshold value ΔX1 and the second threshold value ΔX2 is stored in the data storage device 35.

In other words, the OFF-detection mode is an operation mode for determining whether the light source 4 is in (or, is turned to) the turned-off state. While operating in the OFF-detection mode, the state determiner 32 performs the determination process for determining the turned-off state, based on the first reference voltage Vr1 and the first threshold value ΔX1 retrieved from the data storage device 35, and the detection voltage Vs received.

The ON-detection mode is an operation mode for determining whether the light source 4 is in (or, is turned to) the turned-on state. While operating in the ON-detection mode, the state determiner 32 performs the determination process for determining the turned-on state, based on the second reference voltage Vr2 and the second threshold value ΔX2 retrieved from the data storage device 35, and the detection voltage Vs received.

After the state determiner 32 determines that the light source 4 is turned to the turned-off state while operating in the OFF-detection mode, the state determiner 32 switches to the ON-detection mode. After the state determiner 32 determines that the light source 4 is turned to the turned-on state while operating in the ON-detection mode, the state determiner 32 switches to the OFF-detection mode. In other words, a period during which the state determiner 32 operates in the OFF-detection mode corresponds to a period during which the state determiner 32 continues determining that the light source 4 is in the turned-on state. Also, a period during which the state determiner 32 operates in the ON-detection mode corresponds to a period during which the state determiner 32 continues determining that the light source 4 is in the turned-off state.

Figure 3:
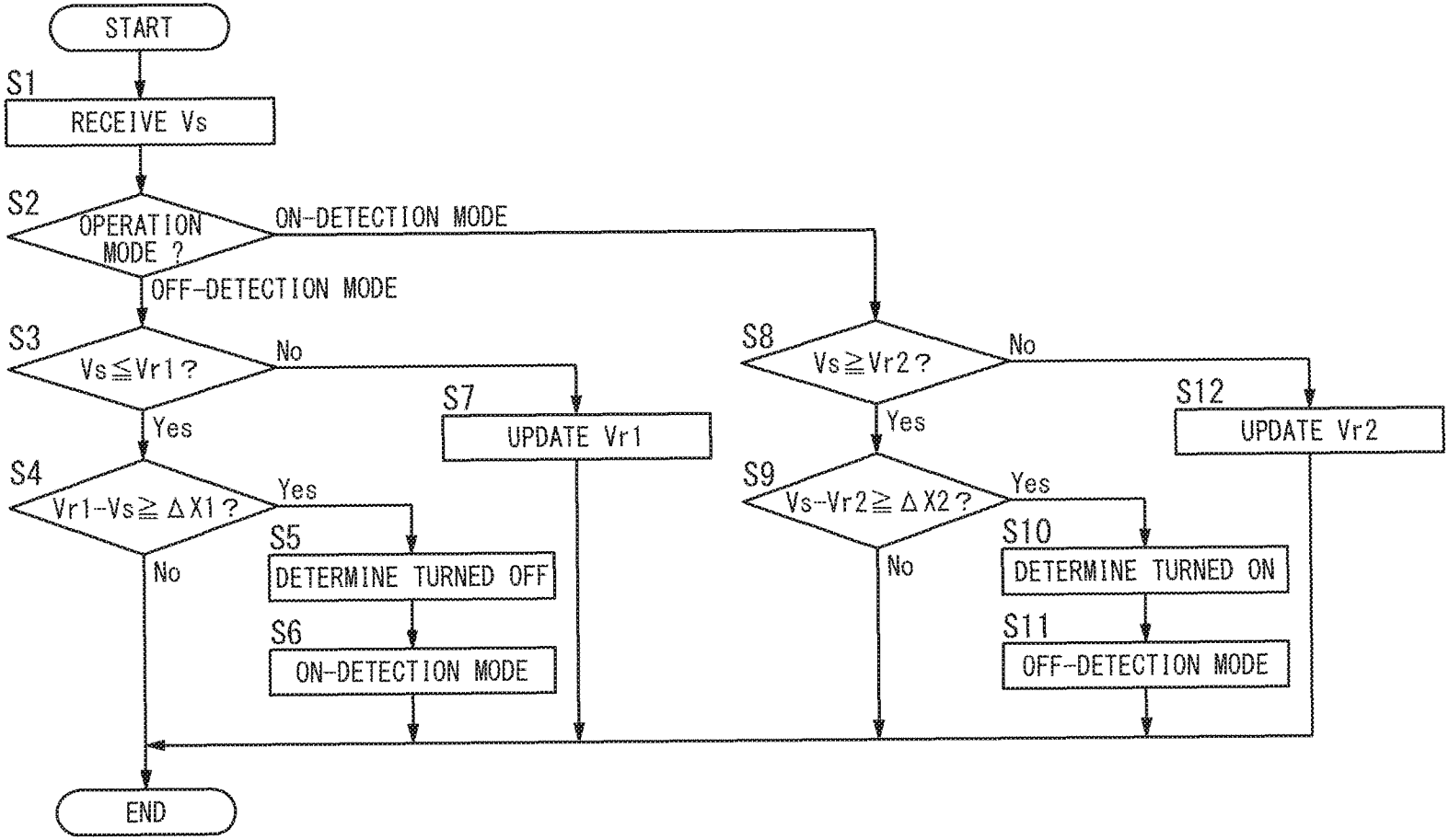
FIG. 3 is a flowchart illustrating the state determination process by the lighting device.

As illustrated in FIG. 3, when the state determiner 32 starts a state determination process of the light source 4, the state determiner 32 receives (acquires) the detection voltage Vs (S1). Subsequently, the state determiner 32 determines whether a current operation mode is the OFF-detection mode or the ON-detection mode (S2). When it is determined that the current operation mode is the OFF-detection mode (namely, result of the determination by the state determiner 32 is the turned-on state), the state determiner 32 determines the magnitude relation between the received detection voltage Vs and the first reference voltage Vr1 (S3). When the received detection voltage Vs is equal to or smaller than the first reference voltage Vr1, the state determiner 32 determines whether the first difference [Vr1−Vs] is equal to or larger than the first threshold value ΔX1 (S4). When the first difference [Vr1−Vs] is smaller than the first threshold value ΔX1, the state determiner 32 determines that the turned-on state continues and ends the state determination process.

Referring back to step S4, when the first difference [Vr1−Vs] is equal to or larger than the first threshold value ΔX1, the state determiner 32 determines that the light source 4 is turned from the turned-on state to the turned-off state (S5). Determining that the light source 4 is in the turned-off state, the state determiner 32 switches its operation mode to the ON-detection mode (S6), and ends the state determination process.

Referring back to step S3, when the current detection voltage Vs is larger than the first reference voltage Vr1, the state determiner 32 updates a value of the first reference voltage Vr1 by replacing the current first reference voltage Vr1 with the current detection voltage Vs as a new first reference voltage Vr1, and stores the updated value of the first reference voltage Vr1 in the data storage device 35 (S7). The state determiner 32 ends the state determination process.

Note that the data on the first reference voltage Vr1 stored in the data storage device 35 may be reset every time the operation mode of the state determiner 32 switches from the OFF-detection mode to the ON-detection mode at the Step S6. Alternatively, the data on the first reference voltage Vr1 stored in the data storage device 35 may be reset every time the operation mode of the state determiner 32 switches from the ON-detection mode to the OFF-detection mode at the Step S11.

Referring back to step S2, when it is determined that the current operation mode is the ON-detection mode (namely, result of the determination by the state determiner 32 is the turned-off state), the state determiner 32 determines the magnitude relation between the received detection voltage Vs and the second reference voltage Vr2 (S8). When the received detection voltage Vs is equal to or larger than the second reference voltage Vr2, the state determiner 32 determines whether the second difference [Vs−Vr2] is equal to or larger than the second threshold value ΔX2 (S9). When the second difference [Vs−Vr2] is smaller than the second threshold value ΔX2, the state determiner 32 determines that the turned-off state continues and ends the state determination process.

Referring back to step S9, when the second difference [Vs−Vr2] is equal to or larger than the second threshold value ΔX2, the state determiner 32 determines that the light source 4 is turned from the turned-off state to the turned-on state (S10). Determining that the light source 4 is in the turned-on state, the state determiner 32 switches its operation mode to the OFF-detection mode (S11), and ends the state determination process.

Referring back to step S8, when the current detection voltage Vs is smaller than the second reference voltage Vr2, the state determiner 32 updates a value of the second reference voltage Vr2 by replacing the current second reference voltage Vr2 with the current detection voltage Vs as a new second reference voltage Vr2, and stores the updated value of the second reference voltage Vr2 in the data storage device 35 (S12). The state determiner 32 ends the state determination process.

Note that the data on the second reference voltage Vr2 stored in the data storage device 35 may be reset every time the operation mode of the state determiner 32 switches from the ON-detection mode to the OFF-detection mode at the Step S11. Alternatively, the data on the second reference voltage Vr2 stored in the data storage device 35 may be reset every time the operation mode of the state determiner 32 switches from the OFF-detection mode to the ON-detection mode at the Step S6.

Ending the state determination process, the state determiner 32 repeatedly performs the above-described state determination process shown in FIG. 3 intermittently (at regular intervals or irregular intervals). Specifically, the above described state determination process will be repeatedly performed, even any processes of the switching between the operation modes, the updating of the value of the first reference voltage Vr1, and the updating of the value of the second reference voltage Vr2 is performed. The above described state determination process will also be repeatedly performed, none of the processes of the switching between the operation modes, the updating of the value of the first reference voltage Vr1, and the updating of the value of the second reference voltage Vr2 is performed. Further, the state determination process is continuously performed and repeated, even when a (desired) dimming level is changed while the state determiner 32 operates in the OFF-detection mode.

Since the state determiner 32 of the lighting device 10 is configured to execute the above-described state determination process, the state determiner 32 can certainly determine occurrence of the turned-off state of any of multiple kinds of light sources 4 having different properties. For example, it is assumed that the multiple kinds of light sources 4 may include two kinds of light sources 4*a*, 4*b* having different properties. In this case, any of the two kinds of light sources 4*a*, 4*b* can be connected as a load to the lighting device 10. In this example, the light source 4*a* has a relatively large forward voltage when it is lit. The light source 4*b* has a relatively small forward voltage when it is lit. Specifically, the forward voltage of the light source 4*a* is larger than the forward voltage of the light source 4*b* when they are lit at a same dimming level.

Figure 4:
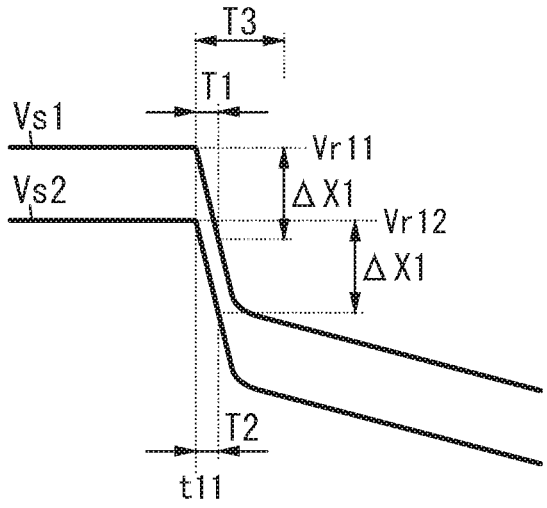
FIG. 4 is a wave form chart illustrating a determination process for determining a turned-off sate by the lighting device.

The detection voltage when the light source 4*a* is employed as a load and is connected to the lighting device 10 will be referred to as a detection voltage Vs1. The detection voltage when the light source 4*b* is employed as a load and is connected to the lighting device 10 will be referred to as a detection voltage Vs2. Provided that the light sources 4*a* and 4*b* are turned on (lit) at a same dimming level, the detection voltage Vs1, which is the detection voltage when the light source 4*a* having a larger forward voltage is connected as a load, would be larger than the detection voltage Vs2, which is the detection voltage when the light source 4*b* having a smaller forward voltage is connected as a load. Therefore, as shown in FIG. 4, in response to the turning off of the power supply from the commercial power supply 5 to the lighting device 10 resulting from the turning off of the switch 6 (timing t11), each of the detection voltages Vs1, Vs2 decreases first sharply and thereafter decreases gradually. Note that "Vr11" shown in FIG. 4 indicates the first reference voltage Vr1 for the detection voltage Vs1, and "Vr12" shown in FIG. 4 indicates the first reference voltage Vr1 for the detection voltage Vs2. The gradient of the detection voltage Vs (decreasing rate of the detection voltage Vs) after the turning off of the power supply to the lighting device 10 may be referred to as a discharging speed of the capacitor C1, and depends on a capacitance of the capacitor C1.

As shown in FIG. 4, even any of the light sources 4*a* and 4*b* is employed as a load and connected to the lighting device 10, the state determiner 32 determines that the light source 4 is turned to the turned-off state when the first difference [Vr1−Vs] reaches the first threshold value ΔX1 or more. As shown in FIG. 4, a determination time T1 is substantially the same as a determination time T2, where the determination time T1 is a length of time from a point in time when the switch 6 is turned off to a point in time when the state determiner 32 determines that the light source 4*a* is turned off, and the determination time T2 is a length of time from a point in time when the switch 6 is turned off to a point in time when the state determiner 32 determines that the light source 4*b* is turned off.

When the switch 6 is turned off, the power supply from the commercial power supply 5 to the control power supply 2 is also off, as a result the control voltage Vc decreases to 0 [V] and the control circuit 3 stops operating in response to the decrease in the control voltage Vc. Therefore, in order to enable the state determiner 32 to determine the turned-off state of the light source 4, each of the determination times T1 and T2 needs to be shorter than an operable time T3 defined as a time length from a point in time when the switch 6 is turned off to a point in time when the control circuit 3 stops operating. In the present embodiment, the determination times T1 and T2 with regard to the light sources 4*a* and 4*b* are substantially the same as each other. It is therefore comparatively easy to set a desired value of the first threshold value ΔX1 with which each of the determination times T1 and T2 is shorter than the operable time T3. The control power supply 2 includes, at output state thereof, a smoothing capacitor for smoothing the control voltage Vc. The operable time T3 is determined by (depends on) the capacitance of the smoothing capacitor, and the consumed power by the control circuit 3. The capacitance of the smoothing capacitor of the control power supply 2 is set so that the operable time T3 longer than the above described determination Time T1 (T2) can be ensured.

Accordingly, the state determiner 32 can certainly determine a turned-off state of a light source 4*a* or a light source 4*b* as a load when the power supply to the lighting device 10 is off resulting from turning off of the switch 6 (when the power supply is off), even in the case where any of the light sources 4*a* and 4*b* having different forward voltages is employed as the load and connected to the lighting device 10.

Figure 5:
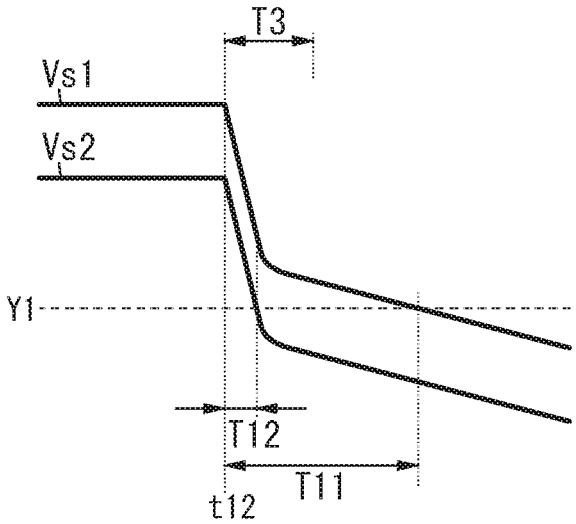
FIG. 5 is a wave form chart illustrating a determination process for determining a turned-off state by a lighting device according to a comparative example.

Next, FIG. 5 shows a state determination process according to a comparative example having different configuration from the present embodiment. The comparative example employs, for determining a turned-off state of a light source 4 connected to a lighting device 10, a threshold value Y1 which is a constant value independent of kinds of light sources 4 connected to the lighting device 10. In the comparative example, after a power supply from a commercial power supply 5 to a lighting device 10 is off (timing t12) resulting from the turning off of a switch 6, a state determiner 32 determines that a light source 4 is turned to a turned-off state when a detection voltage Vs decreases below a threshold value Y1. According to this comparative example, either one selected from the two kinds of light sources 4*a* and 4*b* may be connected as a load. In this case, a determination time T11 would be longer than a determination time T12, where the determination time T11 is a length of time from a point in time when the switch 6 is turned off to a point in time when the turning off of the light source 4*a* is determined, and the determination time T12 is a length of time from a point in time when the switch 6 is turned off to a point in time when the turning off of the light source 4*b* is determined. In this comparative example, therefore, there is an increased possibility that the determination time T11 is longer than an operable time T3 so that the turned-off state of the light source 4*a* may not be detectable when the power supply is off.

Returning back to the present embodiment, the state determiner 32 is configured to determine that the light source 4 is turned to the turned-on state when the second difference [Vs−Vr2] reaches the second threshold value ΔX2 or more. A determination time as a length of time from a point in time when the switch 6 is turned on to a point in time when the state determiner 32 determines that the light source 4*a* is turned on is substantially the same as another determination time as a length of time from a point in time when the switch 6 is turned on to a point in time when the state determiner 32 determines that the light source 4*b* is turned on.

Accordingly, the state determiner 32 can certainly determine a turned-on state of a light source 4*a* or a light source 4*b* as a load when the power supply to the lighting device 10 is started resulting from turning on of the switch 6 (when the power is activated), even in the case of light sources 4*a* and 4*b* having different forward voltages being employed as the load and connected to the lighting device 10.

In the above described configuration, the first threshold value ΔX1 is a predetermined constant value. However, the first threshold value ΔX1 may be variable depending on the magnitude of the first reference voltage Vr1. In this case, the first threshold value ΔX1 increases as an increase of the first reference voltage Vr1, and the first threshold value ΔX1 decreases as a decrease of the first reference voltage Vr1.

Likewise, the second threshold value ΔX2 is a predetermined constant value, in the above described configuration, but the second threshold value ΔX2 may be variable depending on the magnitude of the second reference voltage Vr2. In this case, the second threshold value ΔX2 increases as an increase of the second reference voltage Vr2, and also the second threshold value ΔX2 decreases as a decrease of the second reference voltage Vr2.

The data storage device 35 stores mode data indicating that whether the current operation mode of the state determiner 32 is the OFF-detection mode or the ON-detection mode. The mode data in the data storage device 35 is updated whenever the operation mode of the state determiner 32 is switched. Thereafter, when the power supply is turned off once and then re-activated, the state determiner 32 retrieves the mode data, which is stored at the time the power supply is off, from the data storage device 35, and sets its operation mode at the activation of the power according to this retrieved mode data. In other words, the state determiner 32 retrieves, at the time of the power activation, from the data storage device 35 the mode data which has been stored in the data storage device 35 at the time the power supply is off, which means that the state determiner 32 retrieves a previous result of the determination made by the state determiner 32 at the time the power supply is off.

Figure 6:
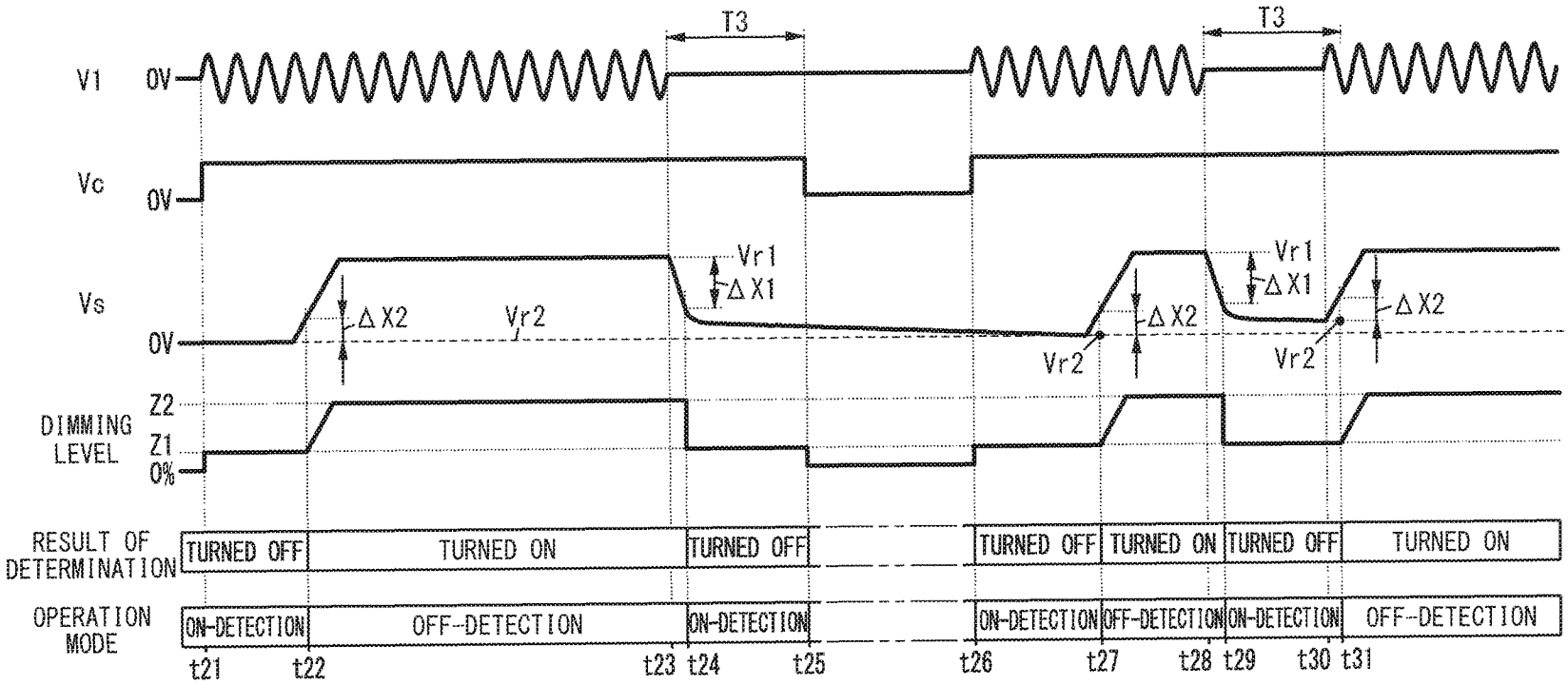
FIG. 6 is a wave form chart illustrating operations of the lighting device according to the embodiment.

Hereinafter, an example of the operation of the control circuit 3 based on the result of the state determination process by the state determiner 32 (result of the determination) is described based on FIG. 6.

In response to the switch 6 being switched from OFF to ON to activate the power supply (timing t21), the control voltage Vc increases and the control circuit 3 starts operating with the control voltage Vc. The dimming controller 343 retrieves the dimming target value from the target value storage device 342. The dimming target value retrieved at this time may be a lower limit level Z1, which is stored at the previous time when the power supply is turned off (alternatively, a lower limit level Z1 stored as a default value). Therefore, the dimming controller 343 starts, at the time of the power activation, the dimming control to adjust the dimming level to the lower limit level Z1. The state determiner 32 retrieves the mode data from the data storage device 35. The mode data retrieved at this time may indicate the ON-detection mode, which is stored at the previous time when the power supply is turned off. According to this retrieved mode data, the state determiner 32 sets its operation mode to the ON-detection mode and starts the state determination process at the time of the power activation.

When a dimming level instructing signal P1 is supplied from an external controller, the instruction receiver 33 of the control circuit 3 receives the dimming level instructing signal P1. The dimming level instructing signal P1 is a signal instructing a desired dimming level of the light source 4.

Hereinafter, the desired dimming level instructed by the dimming level instructing signal P1 is referred to as "instruction level". The dimming level instructing signal P1 may be pulsed voltage signal, and an ON-duty of which decreases as an increase in the instruction level and increases as a decrease in the instruction level. The instruction receiver 33 is configured to determine the instruction level indicated by the dimming level instructing signal P1, based on the ON-duty of the dimming level instructing signal P1.

The target value setter 341 sets the dimming target value of the light source 4 based on the result of the determination by the state determiner 32. Specifically, the target value setter 341 is configured to, while the state determiner 32 determines that the light source 4 is in the turned-off state (namely, while the state determiner 32 operates in the ON-detection mode), set the dimming target value to the lower limit level Z1 of the light source 4. The target value setter 341 is configured to, while the state determiner 32 determines that the light source 4 is in the turned-on state (namely, while the state determiner 32 operates in the OFF-detection mode), set the dimming target value to the instruction level indicated by the dimming level instructing signal P1 received by the instruction receiver 33. The dimming target value set by the target value setter 341 is stored in (written into) the target value storage device 342.

It is assumed that a timing t21 is a time when a sufficiently long time has elapsed from a time when the power supply is off previously. The capacitor C1 is therefore fully discharged and the detection voltage Vs is substantially 0 [V]. In this case, the state determiner 32 sets the second reference voltage Vr2 to 0 [V] which is a minimum value of the detection voltage Vs.

The dimming controller 343 controls the DC power supplied from the step-down chopper circuit 13 so that the dimming level of the light source 4 agrees to the lower limit level Z1 (so that the detection value of the inductor current I1 agrees to a value, corresponding to the lower limit level Z1, of the inductor current I1). According to this operation, the detection voltage Vs (DC voltage V4) increases gradually (as an elapse of time).

When the detection voltage Vs increases to reach a level where the second difference [Vs−Vr2] is equal to or larger than the second threshold value ΔX2, the state determiner 32 determines that the light source 4 is turned to the turned-on state (timing t22). In response to the determination that the light source 4 is turned to the turned-on state, the operation mode of the state determiner 32 is switched from the ON-detection mode to the OFF-detection mode, and the target value setter 341 sets the dimming target value to an instruction level Z2 indicated by the dimming level instructing signal P1. Thereafter, the dimming controller 343 controls the DC power supplied from the step-down chopper circuit 13 so that the dimming level of the light source 4 agrees to the instruction level Z2 (so that the detection value of the inductor current I1 agrees to a value, corresponding to the instruction level Z2, of the inductor current I1). According to this operation, the detection voltage Vs (DC voltage V4) firstly increases gradually (as an elapse of time), and then the dimming level of the light source 4 is adjusted to the instruction level Z2.

While operating in the OFF-detection mode, the state determiner 32 sets the first reference voltage Vr1 to correspond to a maximum voltage of the detection voltage Vs. In this example, the first reference voltage Vr1 may agree to a detection voltage Vs corresponding to the instruction level Z2.

The switch 6 is switched from ON to OFF and the power supply is turned off at a timing t23, but the voltage level of the control voltage Vc is maintained for the operable time T3 after the timing t23. The detection voltage Vs decreases gradually and, before the operable time T3 elapses from the timing t23, reaches a level where the first difference [Vr1−Vs] is equal to or larger than the first threshold value ΔX1 and as a result the state determiner 32 determines that the light source 4 is turned to the turned-off state (timing t24). In response to the determination that the light source 4 is turned to the turned-off state, the operation mode of the state determiner 32 is switched from the OFF-detection mode to the ON-detection mode, and the target value setter 341 sets the dimming target value to the lower limit level Z1. While operating in the ON-detection mode, the state determiner 32 sets the second reference voltage Vr2 to correspond to a minimum voltage of the detection voltage Vs.

After the operable time T3 elapses from the timing t23 (and the control voltage Vc decreases to 0 [V]), the control circuit 3 stops operating (timing t25). At this timing, mode data indicating "ON-detection mode" which is the operation mode of the state determiner 32 at the time the power supply is turned off, is stored in the data storage device 35. The data storage device 35 also stores, as the second reference voltage Vr2, a minimum voltage of the detection voltage Vs during a period from the timing t24 to the timing t25. The target value storage device 342 stores, as the data on the dimming target value, the data indicating the lower limit level Z1 which is the dimming target value set by the target value setter 341 at the time the power supply is turned off.

When the switch 6 is switched from OFF to ON to reactivate the power supply (timing t26), the control voltage Vc increases and the control circuit 3 starts operating with the control voltage Vc. The dimming controller 343 retrieves the dimming target value from the target value storage device 342. The dimming target value retrieved at this time is the lower limit level Z1, which is stored at the time the power supply is turned off. Therefore, the dimming controller 343 starts, at the time of the power reactivation, the dimming control to adjust the dimming level to the lower limit level Z1. The state determiner 32 retrieves the mode data from the data storage device 35. The mode data retrieved at this time indicates the ON-detection mode, which is stored at the time the power supply is turned off. According to this retrieved mode data, the state determiner 32 sets its operation mode to the ON-detection mode and starts the state determination process at the time of the power reactivation.

The state determiner 32 also retrieves the data on the second reference voltage Vr2 from the data storage device 35. The data on the second reference voltage Vr2 retrieved at this time indicates the minimum voltage of the detection voltage Vs during a period from the timing t24 to the timing t25, stored as the second reference voltage Vr2. While operating in the ON-detection mode after the timing t26, the state determiner 32 compares the detection voltage Vs with the (current) second reference voltage Vr2. When it is determined that a detection voltage Vs is smaller than the (current) second reference voltage Vr2, the state determiner 32 sets this detection voltage Vs (smaller than the current second reference voltage Vr2) to a new second reference voltage Vr2, thereby updating the second reference voltage Vr2.

When the detection voltage Vs increases to reach a level where the second difference [Vs−Vr2] is equal to or large than the second threshold value ΔX2, the state determiner 32 determines that the light source 4 is turned to the turned-on state (timing t27). In response to the determination that the light source 4 is turned to the turned-on state, the operation mode of the state determiner 32 is switched from the ON-detection mode to the OFF-detection mode, and the target value setter 341 sets the dimming target value to the instruction level Z2 indicated by the dimming level instructing signal P1. Thereafter, the dimming controller 343 controls the DC power supplied from the step-down chopper circuit 13 so that the dimming level of the light source 4 agrees to the instruction level Z2. According to this operation, the detection voltage Vs (DC voltage V4) firstly increases gradually, and then the dimming level of the light source 4 is adjusted to the instruction level Z2.

While operating in the OFF-detection mode, the state determiner 32 sets the first reference voltage Vr1 to correspond to a maximum voltage of the detection voltage Vs. In this example, the first reference voltage Vr1 may agree to the detection voltage Vs corresponding to the instruction level Z2.

After the switch 6 is switched from ON to OFF and the power supply is turned off (timing t28), the detection voltage Vs decreases gradually and, before the operable time T3 elapses from the timing t28, reaches a level where the first difference [Vr1−Vs] is equal to or larger than the first threshold value ΔX1 and as a result the state determiner 32 determines that the light source 4 is turned to the turned-off state (timing t29). In response to the determination that the light source 4 is turned to the turned-off state, the operation mode of the state determiner 32 is switched from the OFF-detection mode to the ON-detection mode, and the target value setter 341 sets the dimming target value to the lower limit level Z1.

In this example, the switch 6 is switched from OFF to ON to reactivate the power (timing t30) before the operable time T3 elapses from the timing t28. In this case, since the power is reactivated before the control voltage Vc reaches 0 [V], the control circuit 3 continues operating. Accordingly, the dimming controller 343 continues the dimming control to adjust the dimming level to the lower limit level Z1.

When the detection voltage Vs increases to reach a level where the second difference [Vs−Vr2] is equal to or large than the second threshold value ΔX2, the state determiner 32 determines that the light source 4 is turned to the turned-on state (timing t31). In response to the determination that the light source 4 is turned to the turned-on state, the operation mode of the state determiner 32 is switched from the ON-detection mode to the OFF-detection mode, and the target value setter 341 sets the dimming target value to the instruction level Z2 indicated by the dimming level instructing signal P1. Thereafter, the dimming controller 343 controls the DC power supplied from the step-down chopper circuit 13 so that the dimming level of the light source 4 agrees to the instruction level Z2. According to this operation, the detection voltage Vs (DC voltage V4) firstly increases gradually, and then the dimming level of the light source 4 is adjusted to the instruction level Z2.

With the above configuration, while the state determiner 32 determines that the light source 4 is in the turned-off state, the target value setter 341 sets the dimming target value to the lower limit level Z1 and stores the dimming target value in the target value storage device 342. Therefore, at a time of a next power activation, the dimming controller 343 can retrieve the dimming target value (equals to the lower limit level Z1) from the target value storage device 342 to adjust the dimming level at the power activation to the lower limit level Z1.

In addition, the state determiner 32 can certainly determine occurrence of the turned-off state of any of the light sources 4*a* and 4*b* having different forward voltages at the time the power supply is turned off when the switch 6 is switched from ON to OFF. Therefore, even any of the light sources 4*a* and 4*b* is employed as a load, the dimming controller 343 can start operating to control the light source with the lower limit level Z1 at a next power activation. As a result, even any of the light sources 4*a* and 4*b* is employed as a load, the dimming level is adjusted (limited) to the lower limit level Z1 at a power activation. It is accordingly possible to certainly reduce a stress on the light source 4*a*, 4*b* at the power activation.

Figure 7A:
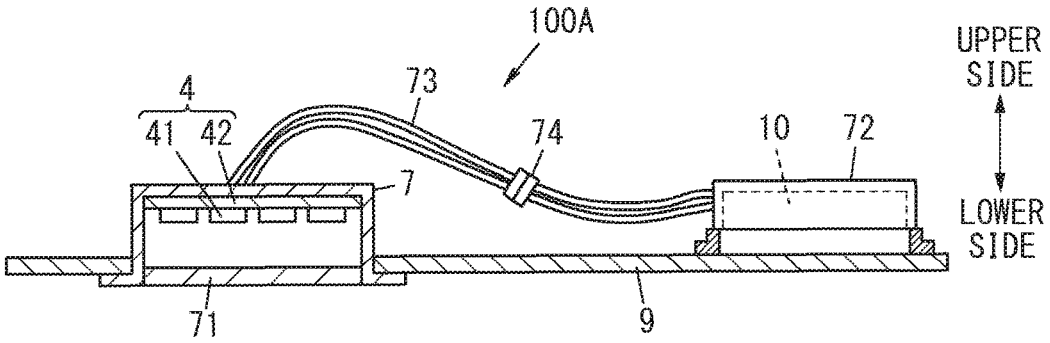
FIG. 7A is a cross-sectional view of a luminaire according to the embodiment of the present disclosure.

FIG. 7A shows a luminaire 100A serving as a downlight recessed in a ceiling panel 9. The luminaire 100A includes the above-described lighting device 10, the light source 4, and a casing 7. The casing 7 is formed from metal such as aluminum into a bottomed circular cylindrical shape with a closed upper face and an open lower face. The light source 4 is provided to the bottom of the upper face. The light source 4 includes LEDs 41 and a substrate 42 on which the LEDs 41 are mounted. The open lower face of the casing 7 is closed by a cover 71 having a circular plate shape. The cover 71 may be made of material having translucency, such as glass or polycarbonate. The lighting device 10 is housed in a metal case 72 having a rectangular box shape and disposed on an upper face of the ceiling panel 9. The lighting device 10 is electrically connected to the light source 4 through an electrical cable 73 and connectors 74.

Figure 7B:
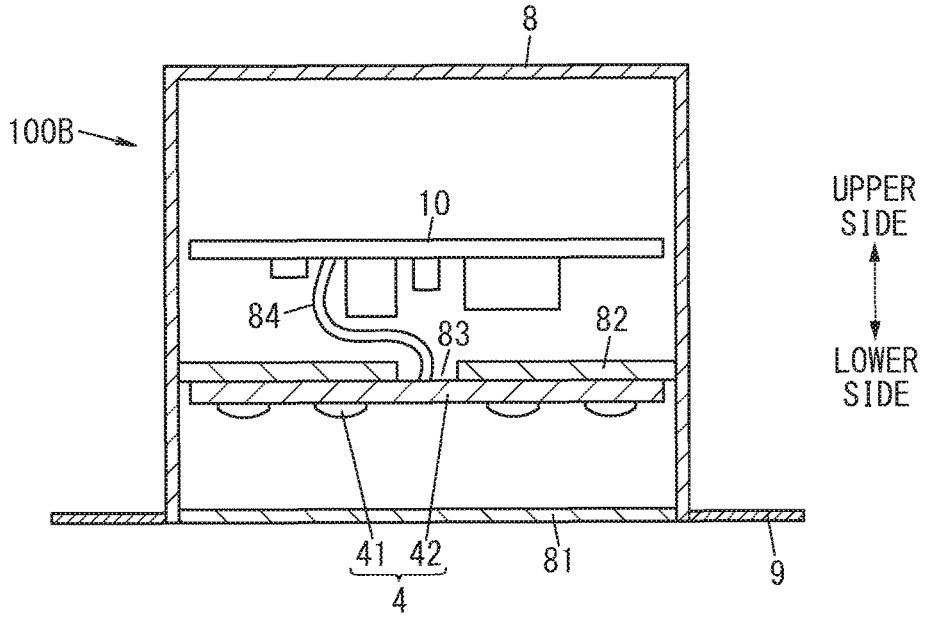
FIG. 7B is a cross-sectional view of another luminaire according to the embodiment of the present disclosure.

FIG. 7B shows a luminaire 100B serving as another kind of a downlight recessed in a ceiling panel 9. The luminaire 100B includes the above-described lighting device 10, the light source 4, and a casing 8. The casing 8 is formed from metal such as aluminum into a bottomed circular cylindrical shape with a closed upper face and an open lower face. The open lower face of the casing 8 is closed by a cover 81 having a circular plate shape. The cover 81 may be made of material having translucency, such as glass or polycarbonate. Inner space of the casing 8 is divided into an upper region and a lower region by a partition board 82 having a circular plate shape. The lighting device 10 is disposed in the upper region above the partition board 82. The light source 4 is disposed on a lower face of the partition board 82. The lighting device 10 is electrically connected to the light source 4 through an electrical cable 84 passing through a cable hole 83 provided in the partition board 82.

Each of the luminaires 100A and 100B includes the lighting device 10 described above. Therefore, each of the luminaires 100A and 100B can offer a technical effect as that of the lighting device 10.

In an alternative example, the light source 4 is not limited to LED, but may include other solid-state light emitting element such as an organic electroluminescence element (OEL), laser diode (LD) and the like.

The control power supply 2 is not limited to receive the AC power from the commercial power supply 5, but may receive power from any of the rectifier circuit (such as a full-wave rectifier) 11, the power factor correction circuit 12, and the step-down chopper circuit 13. While the AC power is supplied from the commercial power supply 5 to the lighting device 10 with the switch 6 turned on, any of the full-wave rectifier 11, the power factor correction circuit 12, and the step-down chopper circuit 13 can supply power to the control power supply 2. Also, while no AC power is supplied from the commercial power supply 5 to the lighting device 10 with the switch turned off, all of the full-wave rectifier 11, the power factor correction circuit 12, and the step-down chopper circuit 13 stops outputting power, so that the control power supply 2 receives no electric power. In other words, the control power supply 2 may be configured to receive the AC power of the commercial power supply 5 which is inputted into the power supply circuit 1, or receive power derived from the AC power of the commercial power supply 5 inputted into the power supply circuit 1.

As described above, a lighting device 10 according to a first aspect of the present embodiment includes a power supply circuit 1, a control power supply 2, and a control circuit 3. The power supply circuit 1 is configured to output a DC voltage V4 in response to input of external power to supply a DC power to a light source 4 that includes at least one solid-state light emitting element (LED 41). The control power supply 2 is configured to output a control voltage Vc in response to input of the external power inputted into the power supply circuit 1 or power derived from the external power inputted into the power supply circuit 1. The control circuit 3 is configured to operate with the control voltage Vc to control the power supply circuit 1. The control circuit 3 includes a voltage detector 31, a state determiner 32, and a power controller 34. The voltage detector 31 is configured to output a detection voltage Vs with a magnitude corresponding to a magnitude of the DC voltage V4 outputted from the power supply circuit 1. The state determiner 32 is configured to make determination of whether the light source 4 is in a turned-on state or in a turned-off state. The power controller 34 is configured to control the DC power supplied from the power supply circuit 1 based on a result of the determination by the state determiner 32. The state determiner 32 is configured to, when a value obtained by subtracting the detection voltage Vs from a reference voltage (first reference voltage Vr1) is equal to or larger than a threshold value (first threshold value ΔX1), determine that the light source 4 is in the turned-off state.

With the lighting device 10 according to this aspect, the state determiner 32 certainly determine a turned-off state of a light source 4*a* or 4*b* employed as a load when a power supply is off, even any of light sources 4*a* and 4*b* having different forward voltages is employed as the load and connected to the lighting device 10.

A lighting device 10 according to a second aspect would be realized in combination with the first aspect. In the second aspect, the control circuit 3 further includes an instruction receiver 33 configured to receive a dimming level instructing signal P1 from an external device. The power controller 34 includes a target value setter 341, a target value storage device 342 of a non-volatile memory, and a dimming controller 343. The target value setter 341 is configured to set a dimming target value defined as a target value of a dimming level of the light source 4. The target value storage device 342 is configured to store data of the dimming target value set by the target value setter 341. The dimming controller 343 is configured to control the DC power supplied from the power supply circuit 1 to adjust the dimming level of the light source 4 to the dimming target value stored in the target value storage device 342. The target value setter 341 is configured to, while the state determiner 32 determines that the light source 4 is in the turned-on state, set the dimming target value based on the dimming level instructing signal P1. The target value setter 341 is further configured to, while the state determiner 32 determines that the light source 4 is in the turned-off state, set the dimming target value to a lower limit level Z1.

With the lighting device 10 according to this aspect, the dimming level of the light source 4 at the time of the power activation is limited to lower limit level Z1. Accordingly, it is possible to reduce the stress on the light source 4 at the time of the power activation.

A lighting device 10 according to a third aspect would be realized in combination with the first or second aspect. In the third aspect, the state determiner 32 is configured to set the reference voltage (first reference voltage Vr1) to correspond to a maximum value of the detection voltage Vs within a period over which the state determiner 32 continues determining that the light source 4 is in the turned-on state.

With the lighting device 10 according to this aspect, the lighting device 10 can set the reference voltage (first reference voltage Vr1) according to an actual (current) dimming level.

A lighting device 10 according to a fourth aspect would be realized in combination with any of the first to third aspects. In the fourth aspect, the reference voltage and the threshold value are defined as a first reference voltage Vr1 and a first threshold value ΔX1, respectively. The state determiner 32 is configured to, when a value obtained by subtracting a second reference voltage Vr2 from the detection voltage Vs is equal to or larger than a second threshold value ΔX2, determine that the light source 4 is in the turned-on state. The second reference voltage Vr2 is lower than the first reference voltage Vr1.

With the lighting device 10 according to this aspect, the state determiner 32 certainly determine a turned-on state of a light source 4*a* or 4*b* employed as a load when a power supply is activated, even any of light sources 4*a* and 4*b* having different forward voltages is employed as the load and connected to the lighting device 10.

A lighting device 10 according to a fifth aspect would be realized in combination with the fourth aspect. In the fifth aspect, the state determiner 32 is configured to set the second reference voltage Vr2 to correspond to a minimum value of the detection voltage Vs within a period over which the state determiner 32 continues determining that the light source 4 is in the turned-off state.

With the lighting device 10 according to this aspect, the lighting device 10 can set the second reference voltage Vr2 according to magnitude of the DC voltage V4 when the light source 4 is in the turned-off state.

A lighting device 10 according to a sixth aspect would be realized in combination with the first aspect. In the sixth aspect, the control power supply 2 continues to output the control voltage Vc to the control circuit 3 for an operable time period beginning when the input of the external power to the control power supply 2 is interrupted, and ending when the control circuit 3 no longer operates, and the state determiner 32 is configured to determine that the light source 4 is in the turned-off state by determining whether the value obtained by subtracting the detection voltage Vs from the reference voltage (first reference voltage Vr1) is equal to or larger than the threshold value (first threshold value ΔX1), during the operable time period.

With the lighting device 10 according to this aspect, the lighting device 10 can more certainly determine the turned-off state of the light source 4.

A lighting device 10 according to a seventh aspect would be realized in combination with the sixth aspect. In the seventh aspect, the state determiner 32 is configured to set a dimming target value, defined as a target value of a dimming level of the light source 4, to a lower limit level in a target value storage device 342 during the operable time period, upon determining that the light source 4 is in the turned-off state.

With the lighting device 10 according to this aspect, even any of the light sources 4*a* and 4*b* having different forward voltages is employed as a load and is connected to the lighting device 10, the dimming level is adjusted (limited) to the lower limit level Z1 at the power activation. It is accordingly possible to more certainly reduce a stress on the light source 4*a*, 4*b* at the power activation.

A lighting device 10 according to an eighth aspect would be realized in combination with the seventh aspect. In the eighth aspect, upon the input of the external power being restored, the power controller 34 controls the DC power supplied from the power supply circuit 1 in accordance with the lower limit level set in the target value storage device 342.

With the lighting device 10 according to this aspect, even any of the light sources 4*a* and 4*b* having different forward voltages is employed as a load and is connected to the lighting device 10, the dimming level is adjusted (limited) to the lower limit level Z1 at the power activation. It is accordingly possible to more certainly reduce a stress on the light source 4*a*, 4*b* at the power activation.

A lighting device 10 according to a ninth aspect would be realized in combination with the eighth aspect. In the ninth aspect, the reference voltage and the threshold value are defined as a first reference voltage Vr1 and a first threshold value ΔX1, respectively. The state determiner 32 is configured to, when a value obtained by subtracting a second reference voltage Vr2 from the detection voltage Vs is equal to or larger than a second threshold value ΔX2, determine that the light source 4 is in the turned-on state. The second reference voltage Vr2 is lower than the first reference voltage Vr1. The power controller 34 is configured to, when the state determiner 32 determines that the light source 4 is in the turned-on state, change control the DC power supplied from the power supply circuit 1 from in accordance with the lower limit level set in the target value storage device 342 to in accordance with a dimming level instructing signal P1.

With the lighting device 10 according to this aspect, the state determiner 32 can certainly determine the turned-on state of the light source 4*a* or 4*b* as a load at the power activation, even in the case of light sources 4*a* and 4*b* having different forward voltages being employed as the load and connected to the lighting device 10.

A lighting device 10 according to a tenth aspect would be realized in combination with the third aspect. In the tenth aspect, the threshold value (first threshold value ΔX1) is a function of the magnitude of the reference voltage (first reference voltage Vr1).

With the lighting device 10 according to this aspect, the state determiner 32 of the lighting device 10 can more certainly determine the turned-off state of the light source 4*a* or 4*b* employed as the load when the power supply is off.

A lighting device 10 according to an eleventh aspect would be realized in combination with the fourth aspect. In the eleventh aspect, the second threshold value ΔX2 is a function of the magnitude of the second reference voltage Vr2.

With the lighting device 10 according to this aspect, the state determiner 32 of the lighting device 10 can more certainly determine the turned-on state of the light source 4*a* or 4*b* employed as the load when the power supply is on.

A luminaire 100A, 100B according to a twelfth aspect of the present embodiment includes the lighting device 10 according to any one of the first to eleventh aspects; a light source 4 including at least one solid-state light emitting element (LED 41) and supplied with the DC power from the lighting device 10; and a casing 7, 8 to which the light source 4 is attached.

The luminaire 100A, 100B includes the lighting device 10. With the luminaire 100A, 100B, accordingly, it is possible to certainly determine a turned-off state of a light source 4*a* or 4*b* employed as a load when a power supply is turned off, even any of light sources 4*a* and 4*b* having different forward voltages is employed as the load and connected to the lighting device 10.

The above described embodiment and modifications are merely examples of the present disclosure. The present disclosure is not limited to the embodiment and modifications described above. Even in other than the embodiment and modifications described above, numerous modifications and variations can be made according to designs and the like without departing from the technical ideas according to the present disclosure.

The invention claimed is:

1. A lighting device, comprising:

a power supply circuit configured to output a DC voltage in response to input of external power to supply a DC power to a light source that includes at least one solid-state light emitting element;

a control power supply configured to output a control voltage in response to input of the external power inputted into the power supply circuit or power derived from the external power inputted into the power supply circuit; and a control circuit configured to operate with the control voltage to control the power supply circuit, the control circuit including:

a voltage detector configured to output a detection voltage with a magnitude corresponding to a magnitude of the DC voltage outputted from the power supply circuit;

a state determiner configured to make determination of whether the light source is in a turned-on state or in a turned-off state; and a power controller configured to control the DC power supplied from the power supply circuit based on a result of the determination by the state determiner, the state determiner being configured to, when a value obtained by subtracting the detection voltage from a reference voltage is equal to or larger than a threshold value, determine that the light source is in the turned-off state.

2. The lighting device of claim 1, wherein:

the control circuit further includes an instruction receiver configured to receive a dimming level instructing signal from an external device;

the power controller includes a target value setter configured to set a dimming target value defined as a target value of a dimming level of the light source, a target value storage device configured to store data of the dimming target value set by the target value setter, and a dimming controller configured to control the DC power supplied from the power supply circuit to adjust the dimming level of the light source to the dimming target value stored in the target value storage device, the target value setter is configured to, while the state determiner determines that the light source is in the turned-on state, set the dimming target value based on the dimming level instructing signal, and to, while the state determiner determines that the light source is in the turned-off state, set the dimming target value to a lower limit level.

3. The lighting device of claim 2, wherein the state determiner is configured to set the reference voltage to correspond to a maximum value of the detection voltage within a period over which the state determiner continues determining that the light source is in the turned-on state.

4. The lighting device of claim 3, wherein:

the reference voltage and the threshold value are defined as a first reference voltage and a first threshold value, respectively;

the state determiner is configured to, when a value obtained by subtracting a second reference voltage from the detection voltage is equal to or larger than a second threshold value, determine that the light source is in the turned-on state; and the second reference voltage is lower than the first reference voltage.

5. The lighting device of claim 4, wherein the state determiner is configured to set the second reference voltage to correspond to a minimum value of the detection voltage within a period over which the state determiner continues determining that the light source is in the turned-off state.

6. The lighting device of claim 2, wherein:

the reference voltage and the threshold value are defined as a first reference voltage and a first threshold value, respectively;

the state determiner is configured to, when a value obtained by subtracting a second reference voltage from the detection voltage is equal to or larger than a second threshold value, determine that the light source is in the turned-on state; and the second reference voltage is lower than the first reference voltage.

7. The lighting device of claim 6, wherein the state determiner is configured to set the second reference voltage to correspond to a minimum value of the detection voltage within a period over which the state determiner continues determining that the light source is in the turned-off state.

8. The lighting device of claim 1, wherein the state determiner is configured to set the reference voltage to correspond to a maximum value of the detection voltage within a period over which the state determiner continues determining that the light source is in the turned-on state.

9. The lighting device of claim 8, wherein:

the reference voltage and the threshold value are defined as a first reference voltage and a first threshold value, respectively;

the state determiner is configured to, when a value obtained by subtracting a second reference voltage from the detection voltage is equal to or larger than a second threshold value, determine that the light source is in the turned-on state; and the second reference voltage is lower than the first reference voltage.

10. The lighting device of claim 9, wherein the state determiner is configured to set the second reference voltage to correspond to a minimum value of the detection voltage within a period over which the state determiner continues determining that the light source is in the turned-off state.

11. The lighting device of claim 8, wherein the threshold value is a function of the magnitude of the reference voltage.

12. The lighting device of claim 1, wherein:

the reference voltage and the threshold value are defined as a first reference voltage and a first threshold value, respectively;

the state determiner is configured to, when a value obtained by subtracting a second reference voltage from the detection voltage is equal to or larger than a second threshold value, determine that the light source is in the turned-on state; and the second reference voltage is lower than the first reference voltage.

13. The lighting device of claim 12, wherein the state determiner is configured to set the second reference voltage to correspond to a minimum value of the detection voltage within a period over which the state determiner continues determining that the light source is in the turned-off state.

14. The lighting device of claim 12, wherein the second threshold value is a function of the magnitude of the second reference voltage.

15. The lighting device of claim 1, wherein:

the control power supply continues to output the control voltage to the control circuit for an operable time period beginning when the input of the external power to the control power supply is interrupted, and ending when the control circuit no longer operates, and the state determiner is configured to determine that the light source is in the turned-off state by determining whether the value obtained by subtracting the detection voltage from the reference voltage is equal to or larger than the threshold value, during the operable time period.

16. The lighting device of claim 15, wherein:

the state determiner is configured to set a dimming target value, defined as a target value of a dimming level of the light source, to a lower limit level in a target value storage device during the operable time period, upon determining that the light source is in the turned-off state.

17. The lighting device of claim 16, wherein:

upon the input of the external power being restored, the power controller controls the DC power supplied from the power supply circuit in accordance with the lower limit level set in the target value storage device.

18. The lighting device of claim 17, wherein:

the reference voltage and the threshold value are defined as a first reference voltage and a first threshold value, respectively;

the state determiner is configured to, when a value obtained by subtracting a second reference voltage from the detection voltage is equal to or larger than a second threshold value, determine that the light source is in the turned-on state;

the second reference voltage is lower than the first reference voltage; and the power controller is configured to, when the state determiner determines that the light source is in the turned-on state, change control the DC power supplied from the power supply circuit from in accordance with the lower limit level set in the target value storage device to in accordance with a dimming level instructing signal.

19. A luminaire comprising:

the lighting device of claim 1;

a light source including at least one solid-state light emitting element and supplied with the DC power from the lighting device; and a casing to which the light source is attached.

* * * * *